United States Patent [19]

Hasegawa et al.

[11] 4,344,465

[45] Aug. 17, 1982

[54] METHOD AND APPARATUS FOR JETTING AUXILIARY FLUID IN JET LOOM

[75] Inventors: Junzo Hasegawa, Oobu; Susumu Kawabata, Aichi; Kazunori Yoshida, Nagoya; Fuzio Suzuki, Toyota; Yusuke Itoh, Oobu; Hajime Suzuki, Anjo; Hiroshi Arakawa, Kariya; Akira Kobayashi, Oobu, all of Japan

[73] Assignees: K.K. Toyoda Jidoshokki Seisakusho; K.K. Toyota Chuo Kenkyusho, both of Aichi, Japan

[21] Appl. No.: 74,755

[22] Filed: Sep. 12, 1979

[30] Foreign Application Priority Data

Sep. 15, 1978 [JP] Japan ..... 53-127290[U]

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 3,978,896 9/1976 Larmit ..... 139/435

FOREIGN PATENT DOCUMENTS 2600369 7/1977 Fed. Rep. of Germany ..... 139/435

2740108 3/1978 Fed. Rep. of Germany ..... 139/435

*Primary Examiner*—Henry Jaudon

*Attorney, Agent, or Firm*—Burgess, Ryan and Wayne

[57] ABSTRACT

An improved method and apparatus for jetting auxiliary fluid to a fluid and filling guide passage formed on a sley in a jet loom wherein a plurality auxiliary nozzles are vertically disposed at predetermined intervals to confront the opening of the guide passage, the entire region in the direction perpendicular to the longitudinal direction of the opening of the guide passage is covered by the auxiliary fluid jetted from the opening of the respective nozzles.

7 Claims, 7 Drawing Figures

METHOD AND APPARATUS FOR JETTING AUXILIARY FLUID IN JET LOOM

BACKGROUND OF THE INVENTION (1) Field of the Invention

The present invention relates to a method and apparatus for jetting auxiliary fluid to a fluid and filling guide passage formed on a sley in a jet loom.

(2) Description of the Prior Art

There is known a filling apparatus in which, in order to maintain a sufficient flying force in wefts filled by a fluid jetted from a main nozzle toward a guide passage formed on a sley, an auxiliary fluid is jetted from auxiliary nozzles disposed so as to confront the guide passage at predetermined intervals. Ordinarily, one round hole directed to the guide passage is formed as a jet opening of the auxiliary nozzle for jetting an auxiliary fluid. Furthermore, there is known an auxiliary nozzle in which a great number of fine holes are formed a range of a round area instead of the above-mentioned round hole, so that the angle of the jetting of a fluid from this auxiliary nozzle is set as close to right angle to the longitudinal axis of this auxiliary nozzle as possible, as disclosed in Japanese Patent Application Laid-Open Specification No. 17368/1976.

In the above-mentioned known auxiliary fluid jetting nozzles, in order to improve the utilization efficiency of the fluid, that is, to obtain a necessary jet speed with a minimum consumption of power, an attempt has been made to reduce the diameter of the opening as much as possible. In such conventional auxiliary fluid jetting apparatus, however, when a weft is caused to fly in the guide passage formed on the sley, since the region where the auxiliary fluid works in the perpendicular direction to the guide passage, particularly, the fluid operating zone just downstream of the fluid jetting point is narrow, the weft tends to run through a region where the action of the auxiliary fluid is relatively weak and escape from the guide passage. Accordingly, it often happens that the weft does not undergo the action of the auxiliary fluid and the weft speed is reduced, and in the worst case, the weft running away from the guide passage is caught on the auxiliary nozzle to render the filling operation impossible. In short, the conventional auxiliary fluid jetting apparatus has a defect in that the stability of the filling operation is extremely bad.

If only the fluid zone corresponding to the guide passage is taken into account, it would appear that the above mentioned problem regarding the auxiliary nozzle could be solved by increasing the diameter of the jetting opening. However, if the diameter of the jetting opening is increased, another defect is caused in that the power consumption is greatly increased. More specifically, since the flow rate of the fluid is lowered as the diameter of the jetting opening is increased, the jetting pressure must be elevated to obtain a predetermined flow rate of the fluid. Moreover, a great number of auxiliary nozzles are arranged in the filling direction and, since these auxiliary nozzles are continuously operated while the loom is driven, an increase of the power consumption cannot be avoided.

As will be apparent from the above-mentioned discussion, in a loom in which auxiliary nozzles are arranged to confront a guide passage mounted on a sley and effect the filling operation, attainment of a stable filling operation is directly related to an increase of the power consumption in an auxiliary fluid jetting apparatus and there are included contradictory problems to be solved in attaining a stable filling operation.

SUMMARY OF THE INVENTION

It is a primary object of the present invention to provide an improved method and apparatus for jetting auxiliary fluid in which the defects involved in the conventional method and apparatus are eliminated and a very good stability of the filling operation can be attained while reducing the power consumption to a very low level.

In accordance with the present invention, the above-mentioned object can be attained by the following method. That is, in a jet loom provided with a transverse fluid and weft guide passage formed on a sley and extended in the filling direction, said guide passage being defined by a plurality of cooperating guide wall sections and having an opening extending in said filling direction and auxiliary nozzles, which nozzles are substantially vertically disposed at predetermined intervals to confront the opening of the above-mentioned guide passage, a method characterized by effectively covering the entire region in the longitudinal direction of the opening of the guide passage by the auxiliary fluid jetted from the opening or openings of respective auxiliary nozzles.

To carry out the above-mentioned method, in the apparatus according to the present invention, a plurality of fluid jetting openings are formed on each one of the auxiliary nozzles in an alignment along the longitudinal direction of the auxiliary nozzle in a condition extending along the longitudinal direction of the auxiliary nozzle, or a slit like opening is formed on each one of the auxiliary nozzles in a condition of extending along the longitudinal direction of the auxiliary nozzle. Consequently, the entire region in the longitudinal direction of the opening of the guide walls confronting said auxiliary nozzle can be covered by the fluid jet discharged from the above-mentioned openings or the slit.

DETAILED DESCRIPTION OF THE PREFERRED EMBODIMENTS

The structure, function and effect of the improved auxiliary fluid jetting method and apparatus of the present invention will now be described with reference to embodiments illustrated in the accompanying drawings.

Figure 1:
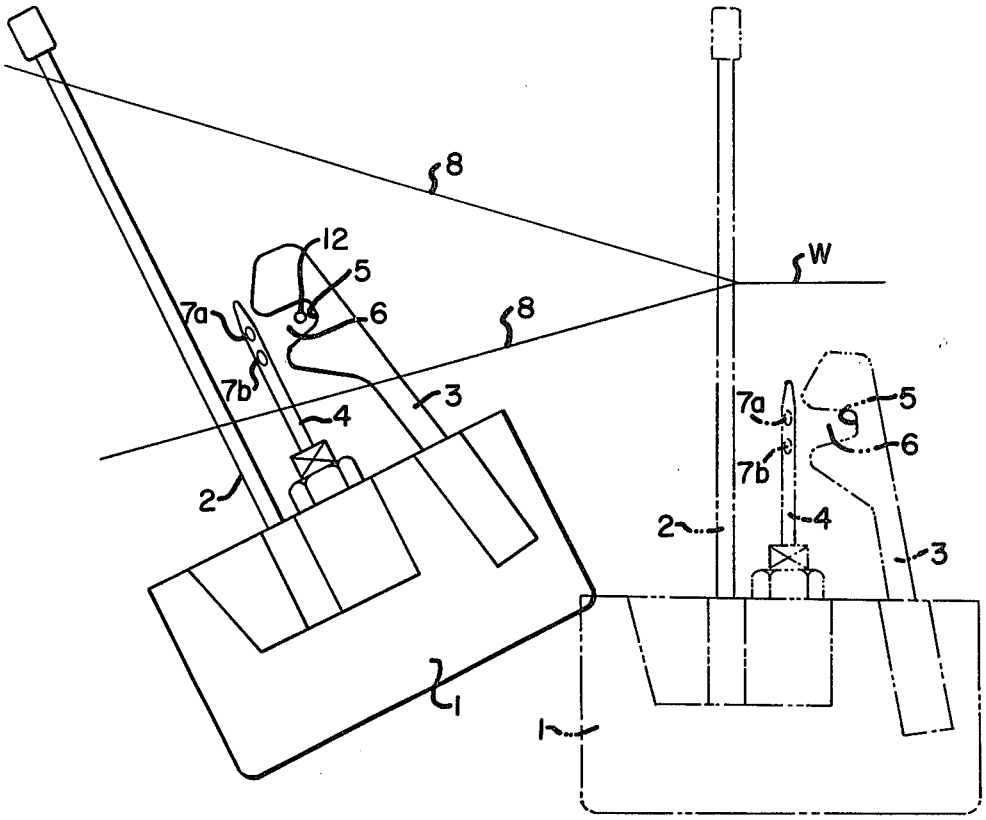
FIG. 1 is a side view illustrating an embodiment of a filling apparatus provided with the auxiliary fluid jetting apparatus of the present invention.

In the filling apparatus and beating mechanism of a jet loom partially illustrated in FIG. 1, a reed 2, a plurality of guide pieces 3 and a plurality of auxiliary nozzles 4 are fixed onto a sley 1. A guide wall 5 semi-opened towards the reed 2 is formed on the top end side of each guide piece 3. A large number of such guide pieces 3 are arranged in the filling direction and a guide passage 6 extending in the filling direction is formed by the guide walls 5. The auxiliary nozzles 4 are arranged at predetermined intervals in such a manner that they confront the guide passage 6, and jetting openings 7*a*, 7*b* for jetting an auxiliary fluid are formed on the top end of each auxiliary nozzle 4. A main nozzle (not shown) is disposed at a position outside the passage of warps 8. A weft 12 is caused to fly through the interior of the guide passage 6 by a fluid jetted from the main nozzle and the filling operation is accomplished by the cooperative action of the fluid jetted from the auxiliary nozzles 4. After completion of the filling operation, the reed 2 reaches a position indicated by an imaginary line by the turning motion of the sley 1, and the beating operation is carried out to form a woven fabric W. Incidentally, the guide passage 6 may be constructed by a so-called modified reed formed by modifying a part of the reed.

Figure 6:
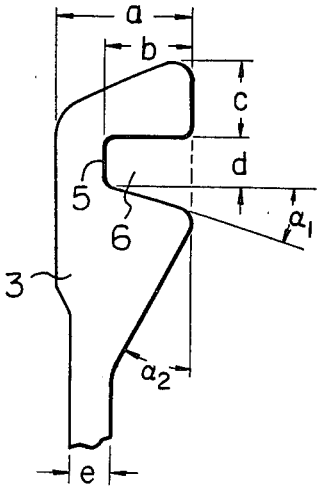
FIG. 6 is a schematic view of a guide piece illustrated in FIG. 5.
Figure 12:
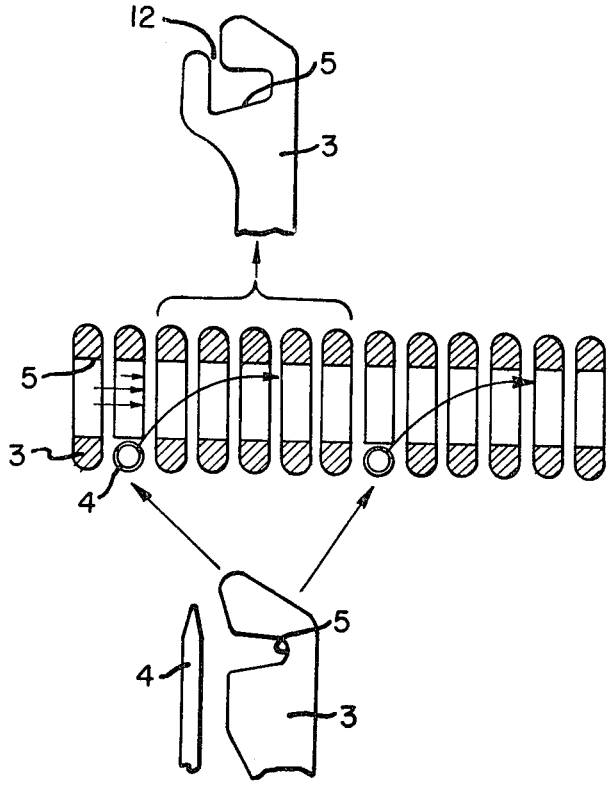
FIG. 12 is a partial sectional plan view illustrating the positional relationship between guide pieces and auxiliary nozzles in accordance with the present invention.
Figure 13:
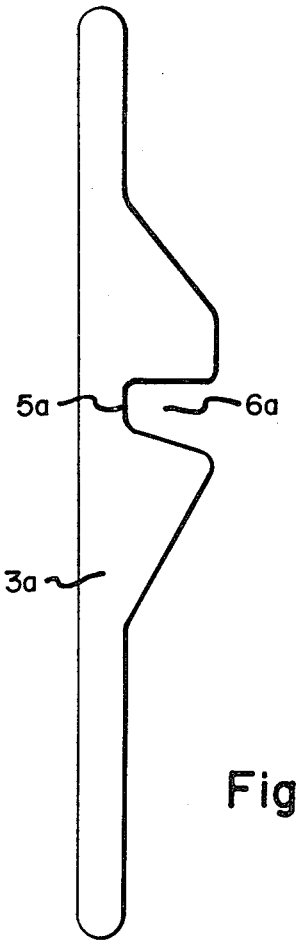
FIG. 13 shows a modified reed having guide walls providing a guide passage.

With respect to the shape of the guide walls 5 of the guide pieces 3, only the guide walls 5 of the guide pieces 3 confronting the auxiliary nozzles 4 may be formed in semi-opened condition, while each one of the guide walls 5 of the remaining guide pieces 3 may be provided with a slit 12 capable of allowing an inserted weft to escape therethrough at the time of the beating operation by the reed 2 as shown in FIG. 12, or the guide walls of all guide pieces 3 may be provided with the semi-opened shape as shown in FIG. 6.

All of the guide members 3 which cooperate with auxiliary nozzles have the same configuration. Those guide members which do not cooperate with auxiliary nozzles have a different configuration, as shown in FIG. 12.

Figure 2:
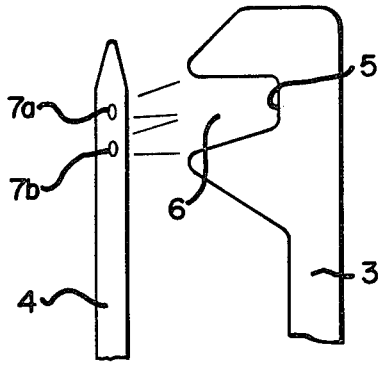
FIG. 2 is a side view illustrating one embodiment of the present invention.
Figure 7:
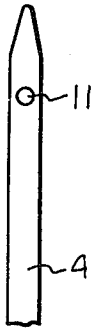
Fig. 7 PRIOR ART
FIG. 7 is a side view illustrating a conventional auxiliary nozzle.
Figure 8A:
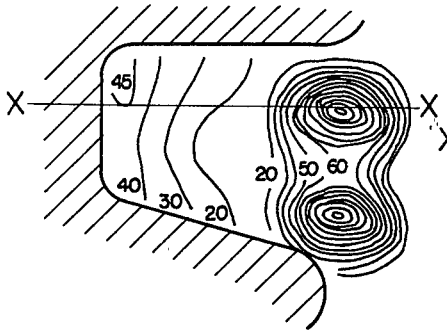
FIGS. 8A, 8B, 8C, 8D and 8E are explanatory diagrams illustrating the flow speed distribution with respect to the present invention as determined in the experimental test.
Figure 8B:
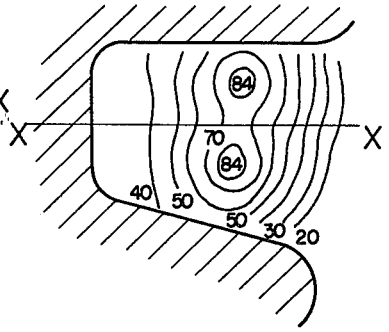
Figure 9A:
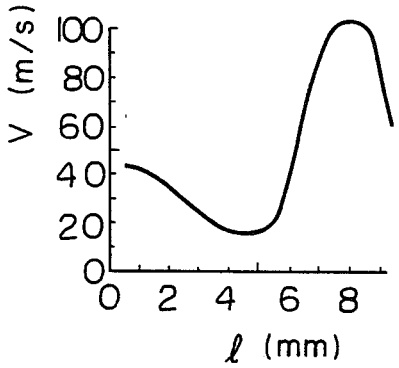
FIGS. 9A, 9B, 9C, 9D and 9E are explanatory diagrams illustrating the change of flow speed in the opening of the guide piece illustrated in FIG. 6, which FIGS. 9A, 9B, 9C, 9D and 9E correspond to the drawings of FIGS. 8A, 8B, 8C, 8D and 8E, respectively.
Figure 9B:
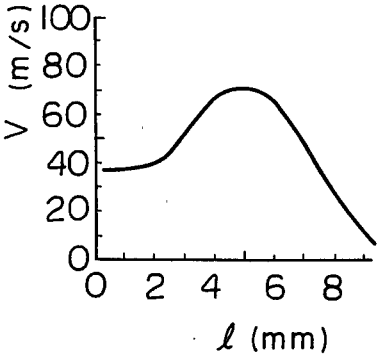
Figure 8C:
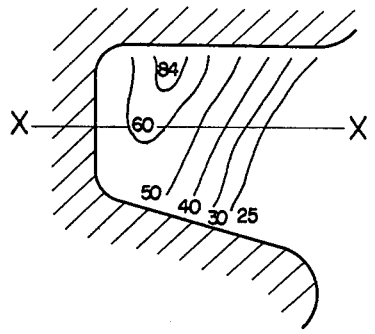
Figure 8D:
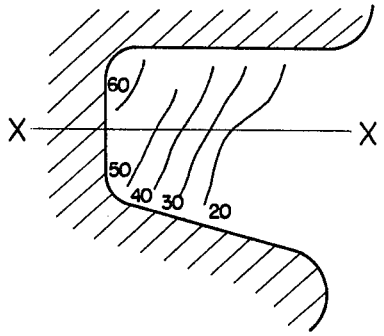
Figure 9C:
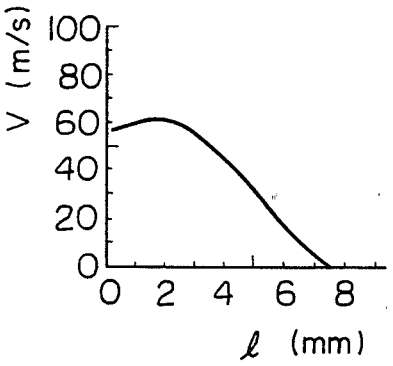
Figure 9D:
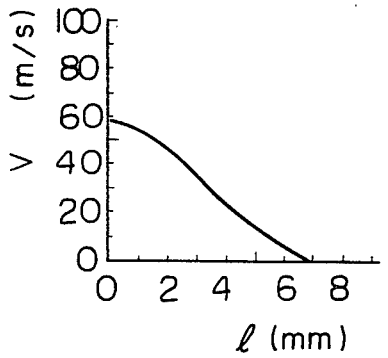
Figure 8E:
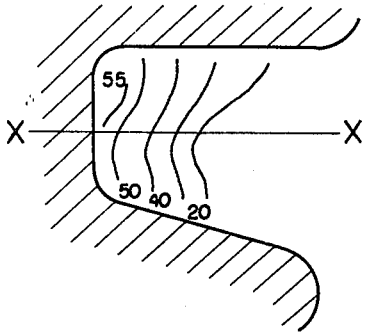
Figure 10A:
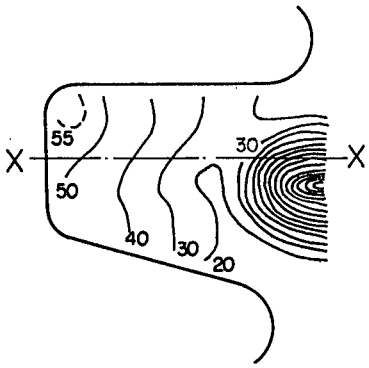
Fig. 10A PRIOR ART
FIG. 10A, 10B, 10C, 10D and 10E are explanatory diagrams illustrating the flow speed distribution with respect to the conventional apparatus as determined in the experimental text.
Figure 9E:
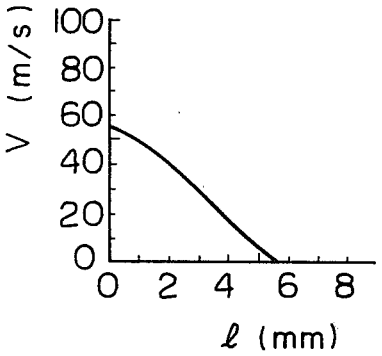
Figure 11A:
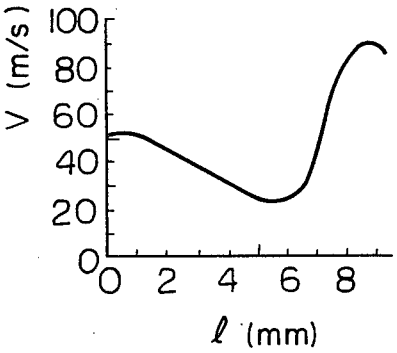
Fig. 11A PRIOR ART
FIG. 11A, 11B, 11C, 11D and 11E are explanatory diagrams illustrating the change of the flow speed in the opening of the guide piece illustrated in FIG. 6, which FIGS. 11A, 11B, 11C, 11D and 11E correspond to the drawings of FIGS. 10A, 10B, 10C, 10D and 10E, respectively.
Figure 10B:
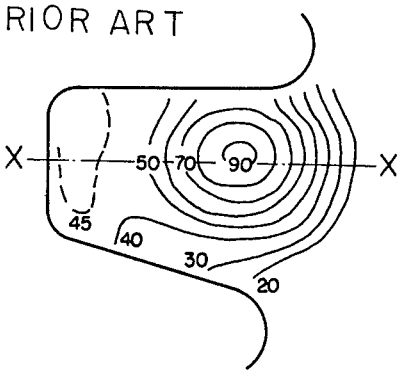
Fig. 10B PRIOR ART
Figure 10C:
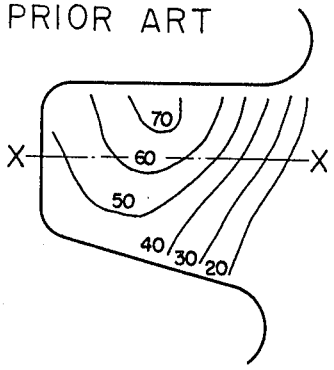
Fig. 10C PRIOR ART
Figure 11B:
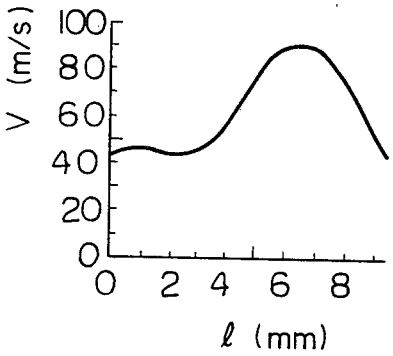
Fig. 11B PRIOR ART
Figure 11C:
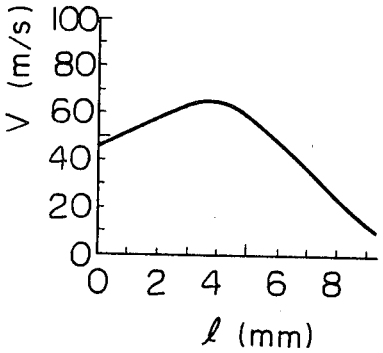
Fig. 11C PRIOR ART
Figure 10D:
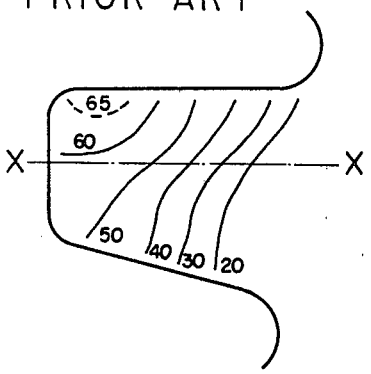
Fig. 10D PRIOR ART
Figure 10E:
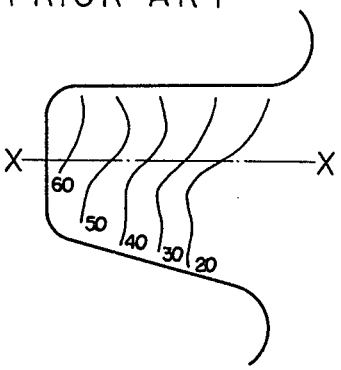
Fig. 10E PRIOR ART
Figure 11D:
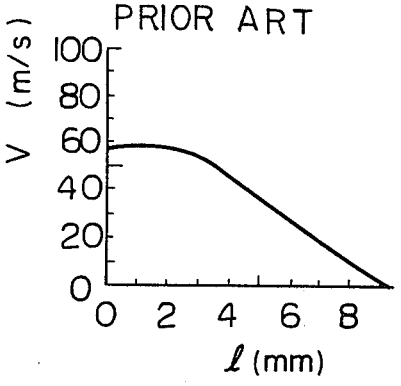
Fig. 11D PRIOR ART
Figure 11E:
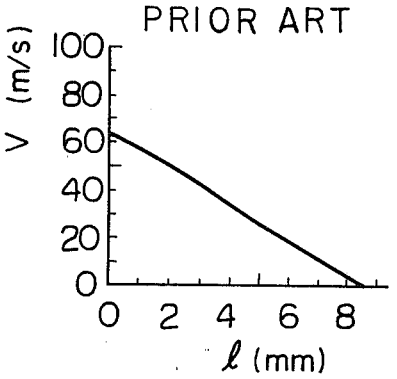
Fig. 11E PRIOR ART

The auxiliary fluid jetting apparatus to be used for the above-mentioned filling apparatus will now be described with reference to FIG. 2. The auxiliary nozzle 4 has a hollow structure, and the top end portion of the auxiliary nozzle 4 is tapered and the terminal end is closed. Two auxiliary fluid jetting openings 7*a*, 7*b* directed to the guide wall 5 are formed in an alignment on the auxiliary nozzle. That is, the jetting openings 7*a*, 7*b* are arranged substantially in a line in the longitudinal direction of the auxiliary nozzle at a position substantially confronting the opening of the guide passage 6. Two auxiliary fluid jetted from the jetting openings 7*a*, 7*b* are combined and directed slightly upwardly from a plane perpendicular to the longitudinal axis of the auxiliary nozzle 4. The upper jetting opening 7*a* is spaced a predetermined distance from the lower jetting opening 7*b*, so that the auxiliary fluid from the upper jetting opening 7*a* substantially covers the upper half of the opening of the guide passage 6 and the fluid from the lower jetting opening 7*b* substantially covers the lower half of the opening of the guide passage 6. The sizes of the openings of both the jetting openings 7*a*, 7*b* are set so that the total amount of the fluid jetted from the two jetting openings 7*a*, 7*b* is substantially equal to the amount of the fluid jetted from the jetting opening 11 of a conventional auxiliary nozzle illustrated in FIG. 7 so as to prevent an increase of power consumption over that of the conventional nozzle. (For example, if the diameter of the conventional jetting opening 11 is 1.5 mm, in the embodiment illustrated in FIG. 2 the diameter of each of the jetting openings 7*a*, 7*b* is adjusted to 1.06 mm.)

Figure 3:
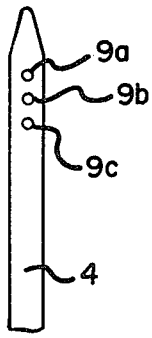
FIG. 3 is a side view illustrating another embodiment of the present invention.
Figure 4:
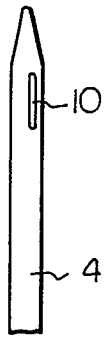
FIG. 4 is a side view illustrating still another embodiment of the present invention.

In another embodiment of the present invention illustrated in FIG. 3, three jetting openings 9*a*, 9*b*, 9*c* are formed substantially along a line in the longitudinal direction of the auxiliary nozzle 4. In this embodiment, the entire region in the direction perpendicular to the longitudinal direction of the opening of the guide passage 6 is covered by the auxiliary fluid more assuredly than in the embodiment illustrated in FIG. 2. In still another embodiment illustrated in FIG. 4, a slit 10 extending in the longitudinal direction of the auxiliary nozzle 4 is formed as the jetting opening. In this embodiment, a slit having a length necessary for jetting the auxiliary fluid so that it covers the entire region in the direction perpendicular to the longitudinal direction of the opening of the guide passage 6 can easily be formed. In the embodiments illustrated in FIGS. 3 and 4, as in the embodiment illustrated in FIG. 2, the sum of the opening sizes of the jetting openings 9*a*, 9*b*, 9*c* or the opening size of the slit 10 is set so that the amount of the jetted fluid is substantially equal to the amount of the fluid jetted from the conventional jetting opening 11 illustrated in FIG. 7, so as to prevent an increase of power consumption over that of the conventional nozzle.

The operation of the auxiliary fluid jetting apparatus of the present invention having the above-mentioned structure will now be described with reference to FIGS. 5 to 8 by comparison with the operation of the conventional apparatus.

Figure 5:
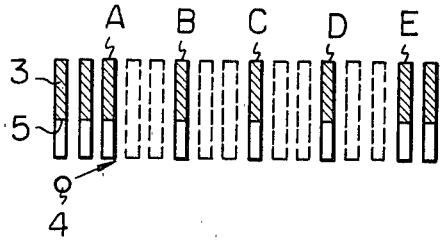
FIG. 5 is a partially sectional plan view illustrating the positional relationship between a guide piece and an auxiliary nozzle utilized for carrying out an experimental test for confirming the function of the present invention.

To confirm the function of the auxiliary fluid jetting apparatus according to the present invention, the distribution of the fluid speed in the guide passage 6 of the guide piece 3 was measured by utilizing a known hot-wire anemometer. The experimental test resulting in this measurement was carried out under the following conditions. That is, as illustrated in FIG. 5, the guide pieces 3 for forming the guide passage 6 were aligned with a pitch of 1 mm; the auxiliary nozzles 4 were aligned on the sley 1 with a pitch of 50 mm in parallel condition to the alignment of the guide pieces 3, at a position 11 mm apart from an imaginary plane connecting the guide wall 5 of each guide piece 3; a fluid air stream having a pressure of 1.6 Kg/cm$^2$ was jetted from each auxiliary nozzle 4 toward a direction defined by an angle of 20° to the alignment of the semi-opened guide pieces 3 as shown in FIG. 2, and the fluid speed in the guide passage 6 was measured by utilizing a known hot-wire anemometer with respect to five guide pieces 3, which are represented by A, B, C, D and E, respectively in FIG. 5. The intervened space between two adjacent guide pieces 3 for the above-mentioned measurement was 10 mm, and each guide piece 3 had the following dimensions.

a: 14 mm, b: 9 mm, c: 7.5 mm, d: 5 mm, e: 4 mm, $\alpha_1$: 15°, $\alpha_2$: 30°, wherein a, b, c, d, e, $\alpha_1$, $\alpha_2$, are indicated in FIG. 6. The data thus measured are represented by the respective drawings FIGS. 8A, 8B, 8C, 8D and 8E, wherein the points having identical fluid speed are connected, and the respective drawings FIG. 9A, 9B, 9C, 9D and 9E, wherein the change of the fluid speed in the guide passage 6 along the line X—X in FIGS. 8A, 8B, 8C, 8D and 8E is shown and the relation between the fluid speed V(m/second) and the position from the guide wall 5 represented by l in mm is shown. The drawings of FIGS. 8A and 9A, FIGS. 8B and 9B, FIGS. 8C and 9C, FIGS. 8D and 9D, FIGS. 8E and 9E correspond to the guide pieces 3 represented by A, B, C, D, and E in FIG. 5, respectively.

Another experimental test was conducted for the guide members having the conventional guide passage 6 under similar conditions to the above-mentioned experimental test, and the data thus obtained are shown in FIGS. 10A, 10B, 10C, 10D and 10E, 11A, 11B, 11C, 11D and 11E.

Referring to FIGS. 10A, 11B, 10B, 11B, 10C, 11C, 10D, 11D, 10E, 11E illustrating the flow speed distribution in the conventional apparatus, at the position A just after jetting from the auxiliary nozzle 4, the auxiliary fluid is not very widely dispersed and spaces not substantially influenced by the auxiliary fluid are present in the upper and lower portions of the guide passage 6. At the position B, the portion having a high flow speed is transferred into the guide passage 6 and the auxiliary fluid is dispersed. However, a space not particularly influenced by the auxiliary fluid is present in the lower portion of the guide passage 6. At the position C and subsequent regions, the auxiliary fluid is widely dispersed and covers substantially the entire region of the guide passage 6. In this flow speed distribution, however, since the jetted fluid is directed slightly upwardly because of the characteristic of the auxiliary nozzle 4 as pointed out hereinbefore, the distribution of the effective flows tends to converge in the upper portion in the guide passage 6.

As will be understood from the above description at the positions A and B, that is, just after jetting, large spaces not substantially influenced by the jetted auxiliary fluid are present in the upper and lower portions of the guide passage 6. Accordingly, wefts are readily allowed to escape from these spaces. Moreover, since the distribution of the effective flows tends to converge in the upper and inner portion of the guide passage 6 at the positions A through E, the influence of the auxiliary fluid is weakened in the lower portion of the guide passage 6 and the conventional apparatus has a defect in that wefts are readily allowed to escape away toward the outside from the lower portion of the guide passage.

In the apparatus of the present invention, as illustrated in FIGS. 8A, 8B, 8C, 8D and 8E, at the position A, two areas where the distributing condition of the effective flows converge are present in the upper and lower portions in the vicinity of the opening of the guide passage 6, and these areas cover substantially the entire region of the opening of the guide passage 6. At the position B, the centers of the upper and lower effective flows are transferred into the guide passage 6, and the two centers thereof are combined into one and the auxiliary fluid is dispersed to cover the entire region in the vertical direction. Accordingly, both the upper and lower spaces of the guide passage 6 are influenced by the auxiliary fluid. At the position C, the auxiliary fluid is further dispersed and the influence of the auxiliary fluid is exerted on the entire space region including both the upper and lower space regions of the guide passage 6. Dispersion of the auxiliary fluid is expanded at the positions D and E, but the state attained at the position C is not substantially changed.

As will be apparent from the above-mentioned change of the distributing condition of the effective flows created by the auxiliary fluid at the positions A through E, even at the positions A and B just after jetting of the auxiliary fluid from the auxiliary nozzle 4, the effective flow covers the substantially the entire upper and lower regions in the vicinity of the opening of the guide passage 6. Furthermore, even if dispersion of the auxiliary fluid is further advanced, this tendency to cover substantially the entire upper and lower regions is maintained up to the position E just before the position where the auxiliary fluid jetted from the subsequent auxiliary nozzle acts. Accordingly, wefts are forced to fly through the guide passage 6 assuredly by the action of the auxiliary fluid, and the filling operation can be performed very stably.

As will be apparent from the above description, the auxiliary fluid jetting method and apparatus of the present invention are characterized by the fact the jetting openings are formed in an alignment or extend in the longitudinal direction of each auxiliary nozzle, and by virtue of this characteristic feature, in the auxiliary fluid jetting apparatus of the present invention, the influence of the auxiliary fluid can be exerted on the entire upper and lower regions of the opening of the guide passage from the point just after jetting of the auxiliary fluid, and the filling operation can be performed very stably by the action of the auxiliary fluid while preventing wefts from flying away from the guide passage. Furthermore, according to the present invention, the power consumption for the jetting of the auxiliary fluid is not increased, but is maintained at substantially the same level as in the conventional auxiliary nozzle.

What is claimed is:

1. In a jet loom comprising a transverse fluid and weft guide passage formed on a sley and extended in the filling direction, said guide passage being defined by a plurality of cooperating guide walls and having an opening extending in said filling direction and subtending a given dimension in a vertical direction substantially perpendicular to said sley, said opening also extending in a longitudinal warp direction, a plurality of auxiliary nozzles disposed at predetermined intervals in said filling direction and substantially transversely directed to confront the opening of said guide passage, each of said auxiliary nozzles having a fluid jetting opening directed toward at least one of said cooperating guide walls defining said guide passage, an improved method comprising positively covering each of said at least one of said guide walls along the entire given direction of the adjacent part of said guide passage opening in said vertical direction by a diverging stream of an effective auxiliary fluid jetted from the fluid jetting opening of the cooperating auxiliary nozzle.

2. An improved method for jetting an auxiliary fluid in a jet loom according to claim 1, wherein each said stream of an effective auxiliary fluid is created by a plurality of fluid streams separately jetted from a plurality of fluid jetting openings formed adjacent each other along said vertical direction of each auxiliary nozzle.

3. An improved method for jetting an auxiliary fluid in a jet loom according to claim 1, wherein each said stream of an effective auxiliary fluid is created by a fluid stream jetted from a slit-like opening extended along said vertical direction of each auxiliary nozzle.

4. The method according to claim 1, wherein at least a predetermined number of said guide walls each confronting a corresponding one of said auxiliary nozzles are semi-opened.

5. In a jet loom comprising a transverse fluid and weft guide passage formed on a sley and extended in the filling direction, said guide passage being defined by a plurality of cooperating guide walls and having an opening extending in said filling direction and subtending a given dimension in a vertical direction substantially perpendicular to said sley, said opening also extending in a longitudinal warp direction, a plurality of auxiliary nozzles disposed at predetermined intervals in said filling direction and substantially transversely directed to confront the opening of said guide passage, each of said auxiliary nozzles having a fluid jetting opening directed toward at least one of said cooperating guide walls defining said guide passage, an improved apparatus comprising means for creating a diverging fluid jet stream toward said guide walls defining said guide passage, said means for creating a diverging fluid jet stream comprising a plurality of openings disposed side-by-side along said vertical direction of each one of said auxiliary nozzles, said diverging fluid jet stream having an effective force imparted to the entire region of said opening in the longitudinal direction of said guide walls, whereby the entire region in the longitudinal direction of the opening of said guide walls confronting said corresponding auxiliary nozzle is effectively covered by a stream of said diverging fluid jet.

6. An improved apparatus for jetting auxiliary fluid according to claim 5, wherein all of said guide walls are semi-opened.

7. An improved apparatus for jetting auxiliary fluid according to claim 5, wherein said guide passage formed by said guide walls is created by a modification of a reed.

* * * * *